US008936103B2

(12) United States Patent
Munro

(10) Patent No.: US 8,936,103 B2
(45) Date of Patent: Jan. 20, 2015

(54) FIRE SUPPRESSION

(71) Applicant: Sensorjet Holdings Limited, Auckland (NZ)

(72) Inventor: Benjamin Adair Munro, Auckland (NZ)

(73) Assignee: Sensorjet Holdings Limited, Auckland (NZ)

( * ) Notice: Subject to any disclaimer, the term of this patent is extended or adjusted under 35 U.S.C. 154(b) by 0 days.

(21) Appl. No.: 13/872,526

(22) Filed: Apr. 29, 2013

(65) Prior Publication Data

US 2013/0233578 A1 Sep. 12, 2013

Related U.S. Application Data

(63) Continuation of application No. 12/666,699, filed as application No. PCT/NZ2007/000288 on Oct. 3, 2007, now Pat. No. 8,448,715.

(30) Foreign Application Priority Data

Oct. 4, 2006 (NZ) ..... 550289
Jun. 25, 2007 (NZ) ..... 556140

(51) Int. Cl.
*A62C 3/00* (2006.01)
*A62C 37/10* (2006.01)
(Continued)

(52) U.S. Cl.
CPC .. *A62C 3/006* (2013.01); *E03C 1/04* (2013.01)
USPC ..... 169/65; 169/54; 169/60; 169/61

(58) Field of Classification Search
CPC ..... A62C 3/006; A62C 31/05; A62C 37/04; A62C 37/36; A62C 37/38; A62C 37/40; A62C 37/44; E03C 1/04; E03C 1/0401; E03C 1/055; E03C 1/057
USPC ..... 169/46, 47, 54, 56, 60, 61, 65
See application file for complete search history.

(56) References Cited

U.S. PATENT DOCUMENTS 1,091,135 A 3/1914 Hetherington
1,555,618 A 9/1925 Aselin
(Continued)

FOREIGN PATENT DOCUMENTS

CA 2164649 12/1995
EP 1844819 10/2007
(Continued)

OTHER PUBLICATIONS

Imperial College, "Student entrepreneurs win 25000 pounds to develop their innovative idea," Mar. 17, 2008, http://www3.imperial.ac.uk/newsandeventspggrp/imperialcollege/newssumary/news 17-3-2008-10-49-53, pp. 1-2.
(Continued)

*Primary Examiner* — Darren W Gorman
(74) *Attorney, Agent, or Firm* — Dann, Dorfman, Herrell and Skillman, P.C.

(57) ABSTRACT

A fire suppression apparatus adapted for connection to a water supply for a faucet has one or more spray nozzles (26), at least one valve (20) operable into an open position to fluidly couple the one or more spray nozzles (26) to a water supply for a faucet (4), a fire sensor (28), and a controller (21) connected to the fire sensor (28), and upon sensing a fire, the fire sensor (28) is adapted to trigger the controller (21) to operate the at least one valve (20) into the open position.

16 Claims, 17 Drawing Sheets

(51) Int. Cl.

| | |
|---|---|
| ***A62C 37/36*** | (2006.01) |
| ***E03C 1/04*** | (2006.01) |

(56) References Cited

U.S. PATENT DOCUMENTS

| | | | | | |
|---|---|---|---|---|---|
| 2,017,841 | A | | 10/1935 | Coleman | |
| 3,588,893 | A | * | 6/1971 | McCloskey | 169/61 |
| 3,866,687 | A | | 2/1975 | Banner | |
| 3,889,754 | A | | 6/1975 | Dunn | |
| 4,079,786 | A | | 3/1978 | Moling | |
| 4,648,462 | A | * | 3/1987 | Odashima | 169/61 |
| 4,671,362 | A | * | 6/1987 | Odashima | 169/61 |
| 4,706,760 | A | * | 11/1987 | Arai et al. | 169/61 |
| 4,755,687 | A | * | 7/1988 | Akiba et al. | 250/554 |
| 4,819,733 | A | * | 4/1989 | Aria et al. | 169/61 |
| 4,821,805 | A | * | 4/1989 | Saito et al. | 169/5 |
| 4,930,570 | A | | 6/1990 | Okayasu | |
| 4,930,579 | A | | 6/1990 | George | |
| 5,501,282 | A | | 3/1996 | Sundholm | |
| 5,548,276 | A | * | 8/1996 | Thomas | 340/578 |
| 5,794,705 | A | | 8/1998 | Kim et al. | |
| 5,899,278 | A | | 5/1999 | Mikulec | |
| 6,039,124 | A | | 3/2000 | Bowman et al. | |
| 6,076,608 | A | | 6/2000 | MacDonald, III et al. | |
| 6,648,077 | B2 | | 11/2003 | Hoffman | |
| 7,013,577 | B2 | | 3/2006 | Kegler | |
| 7,066,273 | B2 | * | 6/2006 | Tan | 169/37 |
| 7,100,701 | B2 | | 9/2006 | Sprakel et al. | |
| 7,231,988 | B2 | | 6/2007 | Jerg et al. | |
| 7,878,258 | B2 | | 2/2011 | Lindstrom et al. | |
| 2004/0256119 | A1 | | 12/2004 | Jerg | |
| 2008/0271903 | A1 | * | 11/2008 | Lindstrom et al. | 169/61 |
| 2009/0159301 | A1 | | 6/2009 | Chatot et al. | |

FOREIGN PATENT DOCUMENTS

| | | | |
|---|---|---|---|
| JP | 2004167027 | | 6/2004 |
| JP | 2004173993 | | 6/2004 |
| WO | 9502434 | | 1/1995 |
| WO | 2008041867 | A9 | 4/2008 |
| WO | 2010058183 | | 5/2010 |
| WO | 2010/082853 | A2 | 7/2010 |
| WO | 2010082853 | A3 | 7/2010 |

OTHER PUBLICATIONS

Helen Hamlyn Centre for Design "Panic Escape," Jun. 30, 2008, http://www.hrc.rca.ac.uk./1460/all/1/snowdon-award.aspx, pp. 1-2.

* cited by examiner

FIRE SUPPRESSION

CROSS REFERENCE TO RELATED APPLICATION

This application is a continuation of U.S. application Ser. No. 12/666,699, now U.S. Pat. No. 8,448,715, which was the National Stage of International Application PCT/NZ2007/000288, filed on Oct. 3, 2007.

FIELD OF THE INVENTION

The present invention relates to an apparatus for suppressing fire, and in particular, but not solely, fire in kitchens.

BACKGROUND OF THE INVENTION

A typical fire suppressing system incorporates a sprinkler, or an array of sprinklers, that are positioned in the ceiling or above a cooking surface, for example in a range hood. A fire sensitive device is positioned somewhere in the room to detect the presence of a fire. When a fire is detected, the sprinkler system is enabled to attempt to suppress the fire.

Such systems require complex installation, due to the geographically separate components of the system and the need to connect to a supply of water or other fire suppressant.

SUMMARY OF THE INVENTION

It is an object of the present invention to provide a fire suppressor that draws from an existing water supply, or at least provides the public with a useful choice.

In a first aspect, the invention is said to comprise in a fire suppression apparatus adapted for connection to a water supply for a faucet, the apparatus comprising:

- a spout and one or more spray nozzles,
- a first valve operable into an open position to fluidly couple the spout to a water supply for a faucet,
- at least one second valve operable into an open position to fluidly couple the one or more spray nozzles to a water supply for a faucet,
- a fire sensor, and
- a controller connected to the fire sensor,
- wherein upon sensing a fire, the fire sensor outputs a signal to trigger the controller to operate the at least one second valve into the open position.

Preferably the fire sensor is a non-contact sensor.

Preferably the first valve is operable into the open position by a person to release water through the spout.

Preferably the at least one second valve is normally in a closed position that fluidly decouples the one or more spray nozzles from a water supply for a faucet.

Preferably the fire sensor is an infrared temperature sensor.

Preferably the fire suppression apparatus is adapted for installation on a surface proximate a water supply for a faucet.

Preferably the infrared temperature sensor is positioned to detect a ceiling temperature when the fire suppression apparatus is installed on a surface proximate a water supply for a faucet.

Preferably the controller is adapted to monitor the infrared temperature sensor and operate the at least one second valve into the open position when the infrared temperature sensor senses a temperature above a first threshold.

Preferably the fire suppression apparatus is installed, water flows from the water supply for a faucet through at least one of the spray nozzles when the at least one second valve is operated into the open position.

Preferably the controller is adapted to operate the at least one second valve into a closed position when the infrared temperature sensor senses a temperature below a second threshold.

Preferably the first and second thresholds are in the range of 40°-70° Celsius. Preferably the infrared temperature sensor has a transparent cover, and said cover possibly comprises Germanium.

Preferably the one or more spray nozzles are arranged at one or more orientations to spray water in at least one direction of a potential fire hazard.

Preferably the fire suppression apparatus is further adapted to install on a kitchen bench and connect to a faucet water supply proximate the bench.

Preferably the one or more spray nozzles are for dousing fires.

Preferably the first valve is continuously variable between the open position and a closed position such that a water supply for a faucet can be fluidly coupled and decoupled to the spout.

In another aspect, the invention is said to comprise in a fire suppression apparatus adapted for connection to a water supply for a faucet, the apparatus comprising:

- one or more spray nozzles,
- at least one valve operable into an open position to fluidly couple the one or more spray nozzles to a water supply for a faucet,
- a fire sensor, and
- a controller connected to the fire sensor,
- wherein upon sensing a fire, the fire sensor is adapted to trigger a controller to operate the at least one valve into the open position.

Preferably the fire sensor is a non-contact sensor.

Preferably the at least one valve is normally in a closed position that fluidly decouples the one or more spray nozzles from a water supply for a faucet.

Preferably the fire sensor is an infrared temperature sensor.

Preferably the apparatus is adapted for installation on a surface proximate a water supply for a faucet.

Preferably the infrared temperature sensor is positioned to detect a ceiling temperature when the fire suppression apparatus is installed on a surface proximate a water supply for a faucet.

Preferably the controller is adapted to monitor the infrared temperature sensor and operate the at least one valve into the open position when the infrared temperature sensor senses a temperature above a first threshold.

Preferably when installed, water flows from the water supply for a faucet through at least one of the one or more spray nozzles when the at least one valve is operated into the open position.

Preferably the controller is adapted to operate the at least one valve into a closed position when the infrared temperature sensor senses a temperature below a second threshold.

Preferably the threshold is in the range of 40°-70° Celsius.

Preferably the infrared temperature sensor has a transparent cover, and said cover possibly comprises Germanium.

Preferably the one or more spray nozzles are arranged at one or more orientations to spray water in at least one direction of a potential fire hazard.

Preferably the one or more spray nozzles are for dousing fires.

Preferably said fire suppression apparatus is further adapted to install on a kitchen bench and connect to a faucet water supply proximate the bench.

Preferably the fire suppression apparatus is installed on a kitchen bench.

In another aspect, the invention is said to comprise in a fire suppression apparatus formed with a faucet, the apparatus comprising:

a valve operable into an open position to fluidly couple one or more spray nozzles to a water supply for a faucet, and a fire detection unit, wherein upon detection of a fire, the fire detection unit operates the valve into the open position.

In another aspect, the invention is said to comprise in a kit of parts for constructing a fire suppression apparatus comprising:

a component forming a base, one or more components containing one or more spray nozzles, a component containing a fire detection sensor and controller, a component containing a spout, and a component containing a handle for operating the spout, wherein each of the components is layered to construct the fire suppression device.

Preferably the fire suppression apparatus has one or more components containing one or more spray nozzles can be orientated relative to the base such that when the fire suppression apparatus is assembled and installed on a surface, the one or more spray nozzles are aimed in at least one direction of a potential fire hazard.

In another aspect, the invention is said to comprise in a fire suppression apparatus adapted for connection to a water supply for a faucet, the apparatus comprising:

a spout and one or more spray nozzles, at least one valve operable into an open position to fluidly couple the one or more spray nozzles to a water supply for a faucet, a fire sensor, and a controller connected to the fire sensor, wherein upon sensing a fire, the fire sensor outputs a signal to trigger the controller to operate the at least one valve into the open position.

Preferably the fire suppression apparatus further includes a hot and cold tap.

In another aspect, the invention is said to comprise in a fire suppression apparatus having a power source for the sensor, controller and/or valve, the power source being one or more of:

a battery mains supply solar panel generator.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The term "comprising" as used in this specification means "consisting at least in part of". Related terms such as "comprise" and "comprised" are to be interpreted in the same manner.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art

BRIEF DESCRIPTION OF THE DRAWINGS

Preferred forms of the invention will now be described with reference to the accompanying drawings.

DETAILED DESCRIPTION OF THE PREFERRED EMBODIMENTS

This specification describes a fire suppressing apparatus for installation in an area nearby a potential fire hazard or hazards. For example, the area may be a kitchen. A kitchen often hosts numerous cooking appliances that may cause a fire. Such cooking appliances comprise ovens, stove tops, toasters.

A fire suppressor is more commonly termed a "fire extinguisher". These terms can generally be used interchangeably. It will be appreciated that due to various factors, a fire extinguisher may not always completely extinguish a fire. However, at least partially extinguishing or suppressing a fire does provide benefits in controlling a fire.

The term "faucet" in this specification is intended to refer to any type of tap or mixer used to control a water supply. The faucet may be a single water outlet, or mix several water supplies together, such as hot and cold water supplies.

Figure 1:
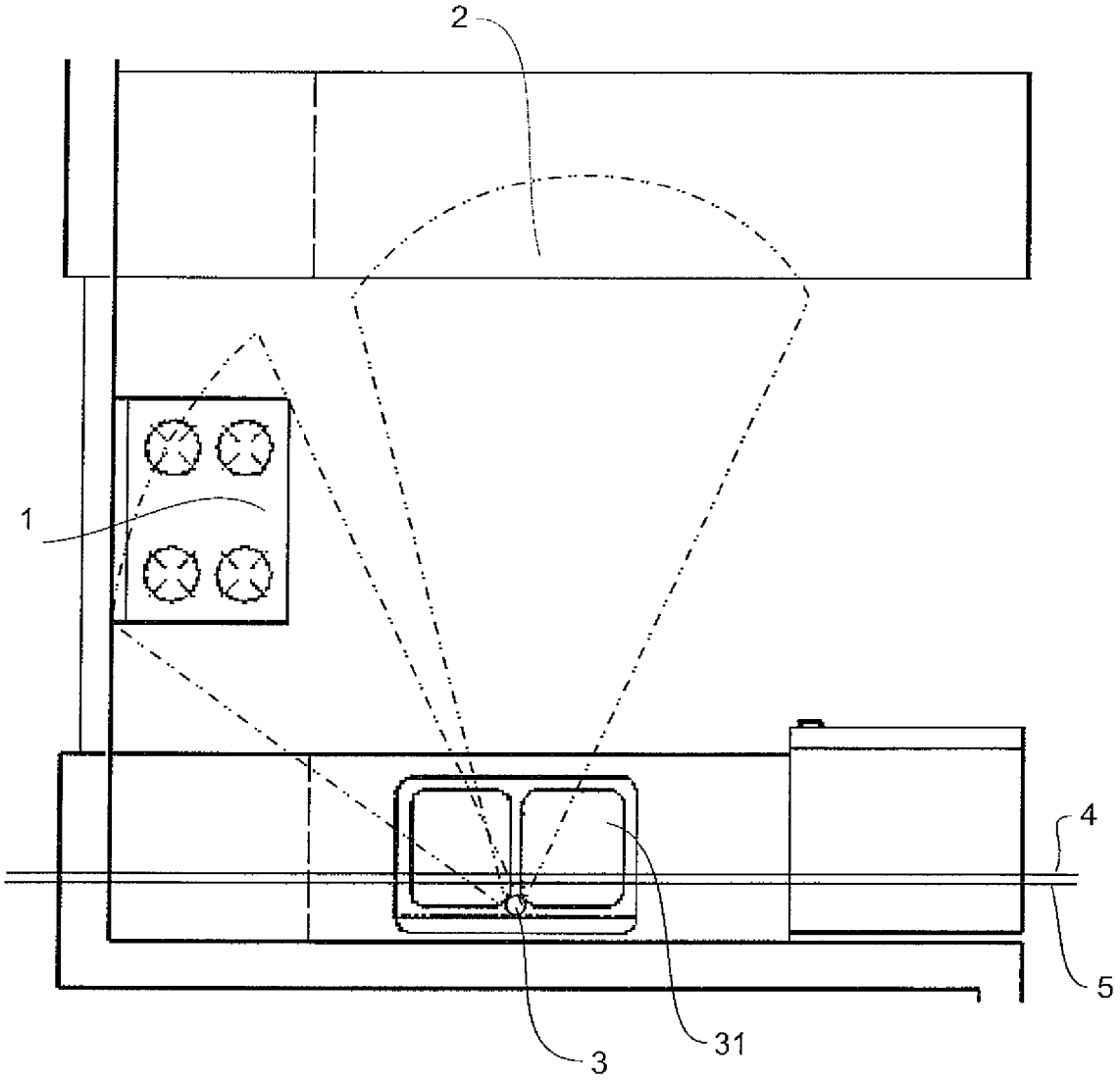
FIG. 1 is a kitchen plan with an example spray pattern from a fire suppressing apparatus.

Referring to FIG. 1, a fire suppressing apparatus 3 according to the invention is placed proximate an existing water supply 4, 5. The water supply may exist to supply, for example, existing faucets and water consuming appliances. The apparatus 3 could be installed on or near a kitchen sink 31.

The fire suppressing apparatus of the invention comprises a plurality of spray nozzles. Each spray nozzle is preferably aimed at a potential fire hazard. FIG. 1 illustrates a pair of spray nozzles wherein one spray nozzle is aimed toward an oven or stove top 1, and another spray nozzle is aimed toward a bench top 2. The desired spray pattern of each spray nozzle can be customised for the particular area when the fire suppressing apparatus is installed.

It may also be advantageous to include a general sprayer designed to spray a mist of water across a local area to effectively douse all local surfaces in case of the fire spreading.

The fire suppressing apparatus 3 could comprise a spout and mixer device that connects to an existing hot and/or cold water supply thus replacing an existing faucet. The fire suppression device may connect to the mains or other water supply by any common plumbing connection, for example, by welding the pipes or a threaded interlocking connection. Alternatively, the fire suppressing apparatus is a unit without a spout and mixer placed in close proximity to an existing faucet, or at least in close proximity to an existing water supply.

Figure 2:
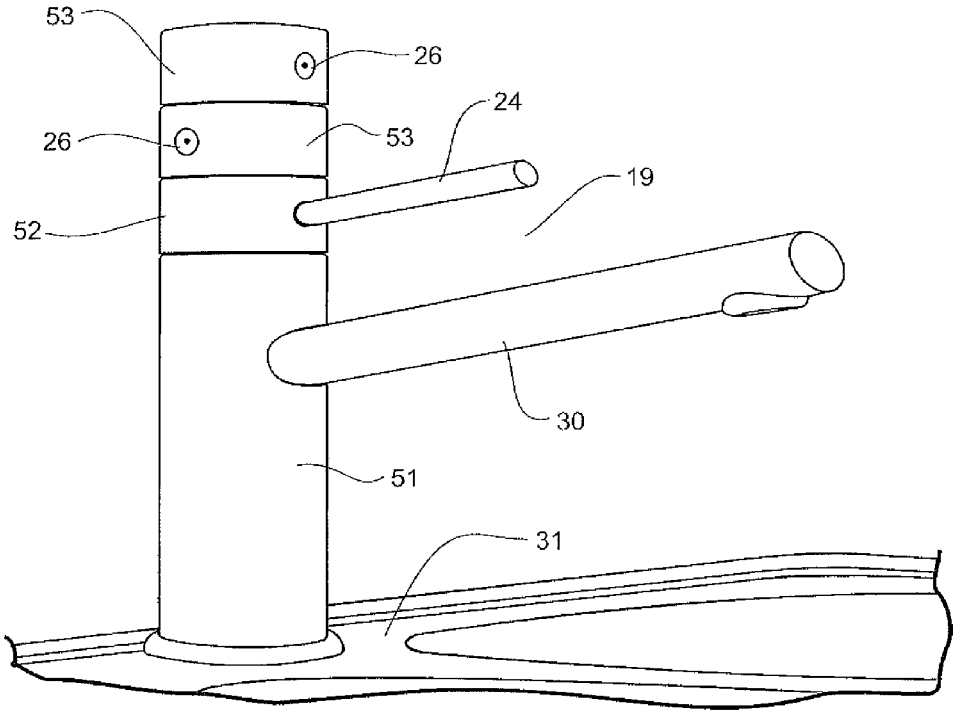
FIG. 2 is a perspective view of a first embodiment of a fire suppressing apparatus.
Figure 3:
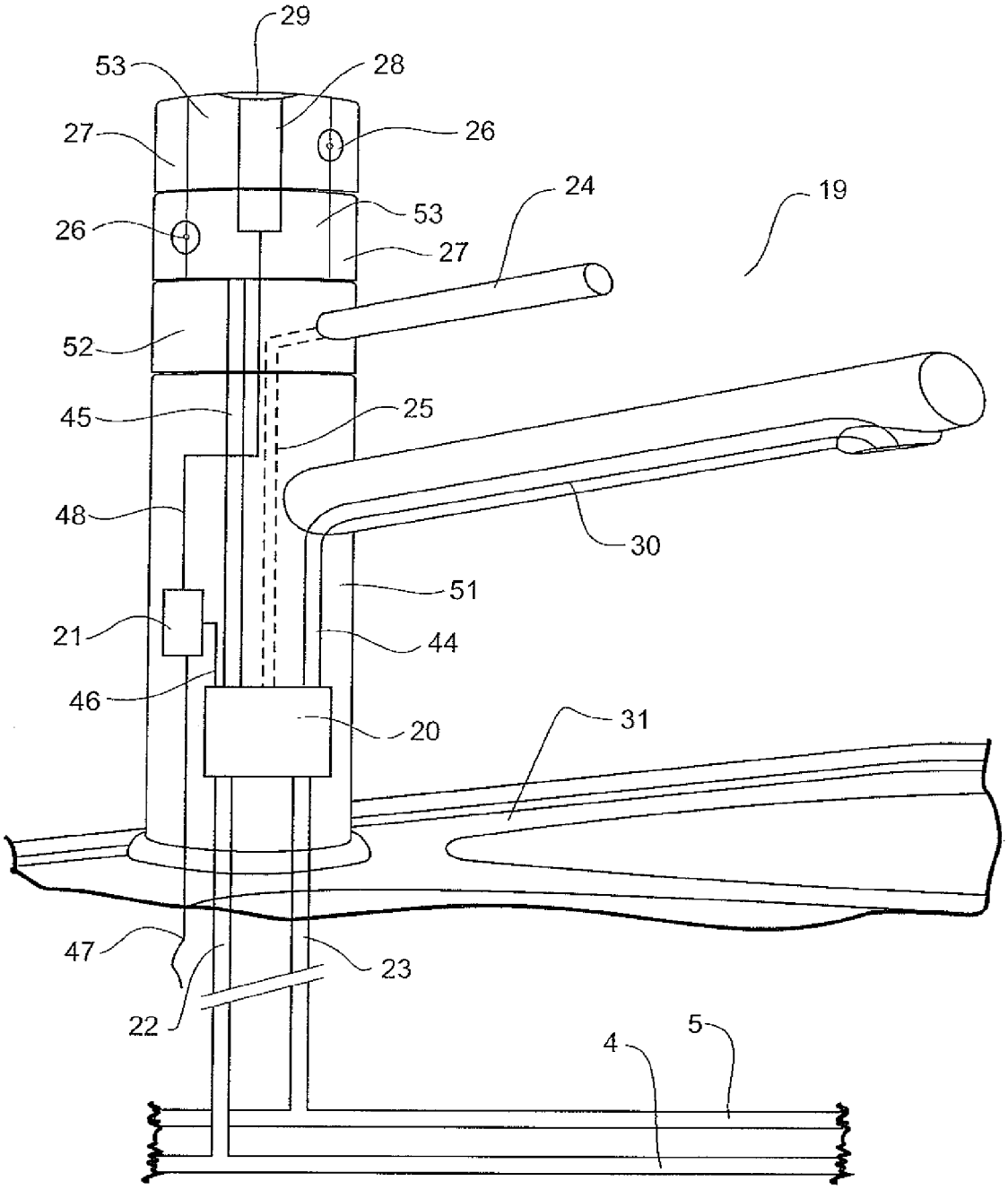
FIG. 3 is a perspective view of the first embodiment showing internal features of the fire suppressing apparatus.

FIGS. 2 and 3 show a first embodiment of the invention whereby the fire suppression apparatus is formed from a number of spray nozzles in a device which also has a spout and a manually operated water control device. In this case the fire suppression device resembles a faucet of a type commonly found in a kitchen. This could be the kind of faucet that is commonly installed on a kitchen sink or bench surfaces 31. Therefore, the fire suppression apparatus can function as a faucet as well as a fire suppressor. FIG. 3 shows a perspective view of the first embodiment illustrating in more detail internal components which form the fire suppression apparatus 19.

Referring to FIGS. 2 and 3 the first embodiment of the invention has a spout and a mixer whereby the fire suppression apparatus is formed from a number of spray nozzles replacing an existing faucet. The fire suppression apparatus 19 comprises a main body 51 that is adapted to install on a kitchen sink or bench 31. A spout 30 extends from the main body 51 and a mixer handle 24 is connected to the main body 51. The mixer handle 24 can be swivelled and lifted by user to control the mixture and flow rate of hot and cold water through the spout 30.

Two spray nozzles 26 are located above the handle. Each spray nozzle can be aimed in a desired direction, and with desired spray pattern and volume characteristics.

A mixing unit is disposed in the main body 51. The mixing unit 20 is preferably supplied by mains pressure or any other supply normally used to supply a faucet. For example, the mixing unit 20 is connected to a household hot and cold water supply 4, 5 through fluid channels 22, 23. The handle 24 is used to provide a user with control over the hot/cold mixture via internal linkage 25. Internal linkage 25 actuates the mixing valve mechanism within the mixing unit 20. The handle also allows the user to control fluid flow rate to the spout 30. Fluid channel 44 connects the mixing unit to the outlet of the spout.

Figure 4:
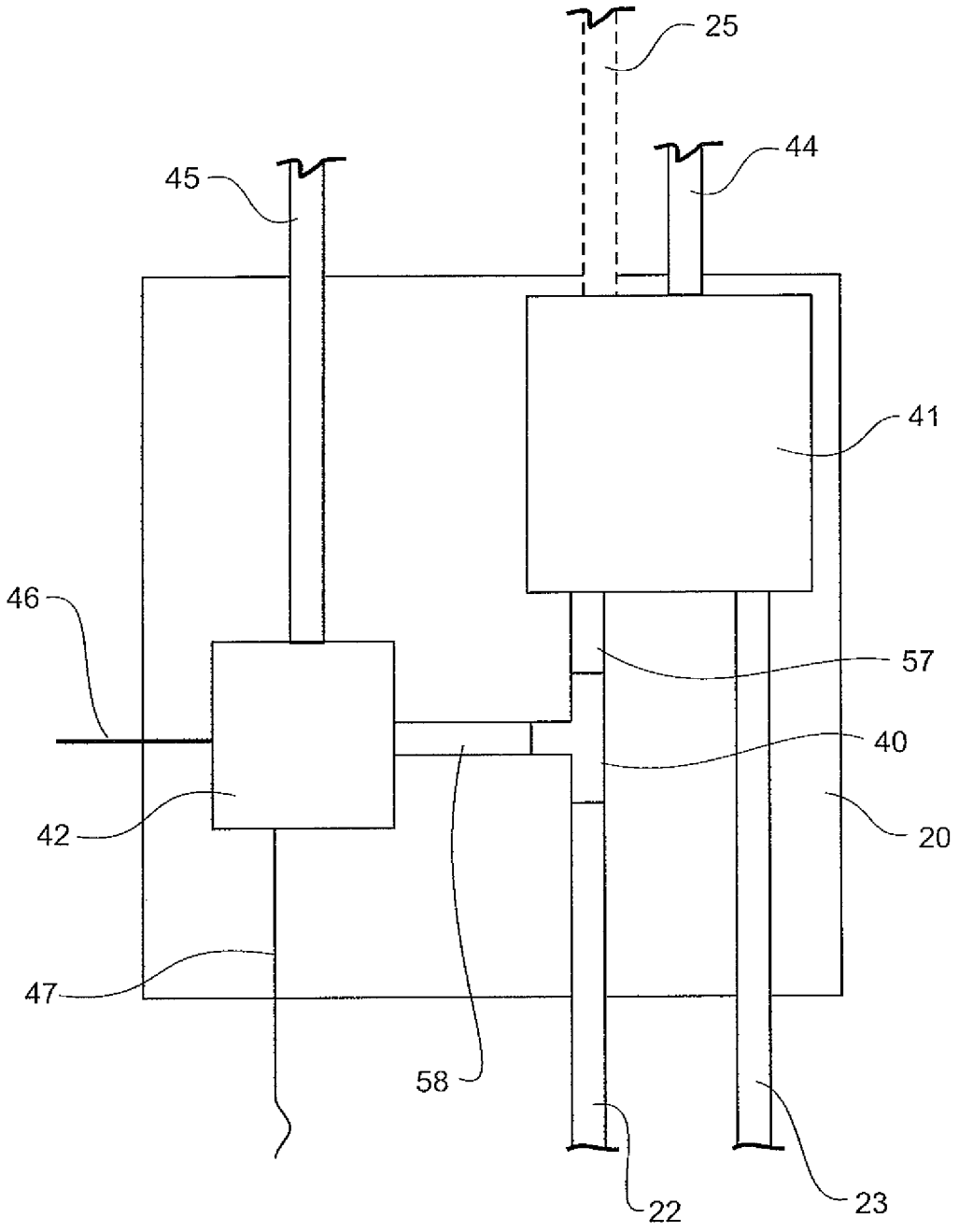
FIG. 4 is a schematic diagram showing further detail of the internal features of the fire suppressing apparatus.

The fire suppressing apparatus also comprises a fire sensor 28 that can sense smoke, heat and/or fire, or another indicator of fire, and a controller unit 21 for operating a valve 42 (shown in FIG. 4). These allow for detection of a fire and control of water supply to the spray nozzles in response.

FIG. 4 illustrates an example of the internal components of the mixing unit 20. The hot and cold water channels 22, 23 are fluidly connected to the mixing unit 20. The cold water channel 22 is split into two fluid channels 57, 58 by a tee 40. The tee 40 is defined by any type of fluid diverging connection as known in the art.

Fluid channel 58 fluidly connects the mains pressure household cold water channel 22 to a valve 42. The valve 42 may be any type of fluid barrier controllable either directly or indirectly by an electrical signal. Preferably the valve 42 is operated by an electrical solenoid between an open and closed position. Pressurised water from supply channel 22 is fluidly connected to supply channel 45 when the valve 42 is in the open position. Pressurised water from supply channel 22 is fluidly disconnected from channel 45 when the valve 42 is in the closed position.

An electrical signal to operate the valve 42 is supplied through wire 46 from the controller 21. The simplest form of wire 46 is a single wire supplying a positive voltage, wherein an electrical ground connection is supplied through the body of the internal components. Alternatively wire 46 may comprise two wires that are isolated from other components in the fire suppressing apparatus.

Fluid channel 57 remains fluidly connected to a mixing unit 41 independent of operation of the valve 42. Similarly, fluid channel 58 remains fluidly connected to valve 42 independent of the operating of the mixing unit 41.

It can be appreciated that for practicality one, or some, or all of the tee 40, fluid channel 58, valve 42 and fluid channel 45 components can be located outside the mixing unit 20 without departing from their intended purpose.

As a further alternative, valve 42 may be plumbed directly to supply channel 22 and provide a first and second output. The first output is plumbed to the mixing unit 41, and a second output is plumbed to the spray nozzles 26.

Valve 42 would divert the water supply to the first output during normal faucet operation, and to the second output if a fire is detected.

Loss in water pressure to the spray nozzles is avoided by the mixer unit being isolated from the spray nozzles when a fire is detected and the faucet is on. This means that the fire suppressing apparatus works when the mixer/spout is operating.

Referring again to FIG. 3, the fire sensor 28 is located on an exterior surface of the fire sensing apparatus 19. Preferably the fire sensor unit is a remote or non-contact smoke, fire or heat sensor or similar. The fire sensor 28 is coupled to the controller 21 by a wire 48. An example of a remote heat sensor is an infrared temperature fire sensor 28, or infrared thermometer. An infrared thermometer has a voltage output that corresponds to the temperature in an aimed direction. Ideally the aimed direction is at the ceiling of a room directly, or at least approximately, above a potential fire hazard.

Alternatively, the aimed direction is at any ceiling space above the fire suppression apparatus where heat from a fire may rise to.

Alternatively the fire sensor could be located anywhere suitable that allows it to measure the heat of objects about the fire suppression apparatus, such as the ceiling. The location may be at, or near the top of the fire suppression apparatus.

It may be advantageous to provide a protective cover 29 above the sensor. Preferably the protective cover 29 transmits substantially all infrared radiation that is incident to it. Germanium or glass has proved an effective infrared transmitting material to construct a protective cover.

Controller unit 21 is supplied with electrical power via wire 47. The electrical power is preferably of low voltage and low current for safety in the presence of water. Preferably the electrical power is of sufficient voltage and current that the fire sensor 28, controller 21 and solenoid valve 42 may operate simultaneously without failure.

The controller unit 21 monitors the output of the fire sensor 28 via wire 48. The controller unit either alone or together with the fire sensor forms a fire detection unit. Preferably the output of the fire sensor 28 is representative of the ceiling temperature. The ceiling temperature will rise when there is a fire in the room before any other part of the room.

Accordingly the controller unit 21 incorporates an upper predetermined temperature threshold that corresponds to the occurrence of a fire. The controller unit signals valve 42 to open via wire 46 when a temperature threshold is exceeded.

The opening of the valve 42 fluidly connects the pressurised mains water source 22 to the plurality of spray nozzles 26 via the fluid channel 45. The spray nozzles therefore spray water in a direction determined upon installation of the fire suppressing apparatus.

Preferably, the controller unit 21 incorporates a lower predetermined temperature threshold that corresponds to when a fire has been suppressed. Controller unit 21 closes valve 42 when the fire sensor 28 determines the ceiling temperature has dropped below the lower predetermined threshold. Accordingly, spraying will cease when the pressurised water supply is disconnected from the spray nozzles.

The upper ceiling temperature threshold required for the controller unit 21 to open the valve 42 has been found to work well when set to between 40°-70° degrees Celsius. The lower temperature threshold required for the controller unit 21 to close the valve has been found to work well when set to between 40°-70° degrees Celsius. However, the upper and lower predetermined temperature thresholds may be equal, or different. The temperature thresholds may further be customised to a particular room requirement. For example, a large room may require a lower upper ceiling temperature threshold than a small room.

Figure 5:
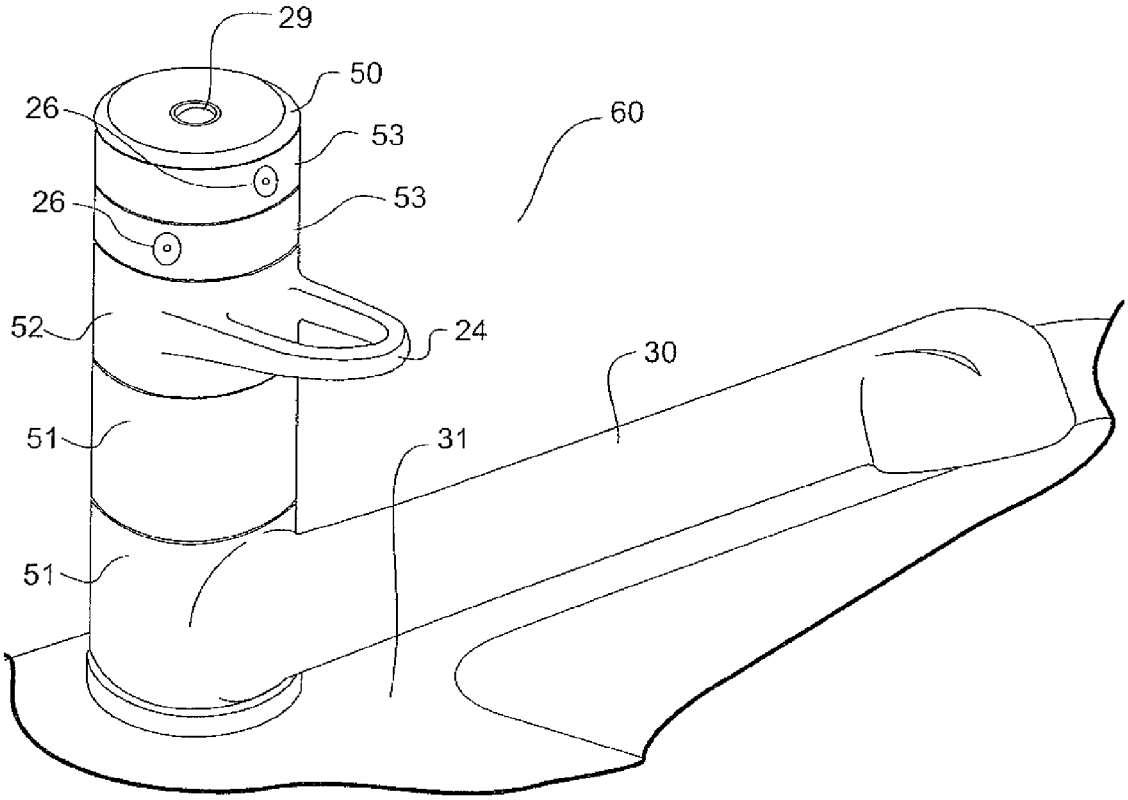
FIG. 5 is a perspective view showing an alternative exterior of the fire suppressing apparatus.

FIG. 5 provides an alternative exterior 60 to the fire suppression apparatus 19 of the first embodiment. This functions in the same manner.

Figure 6:
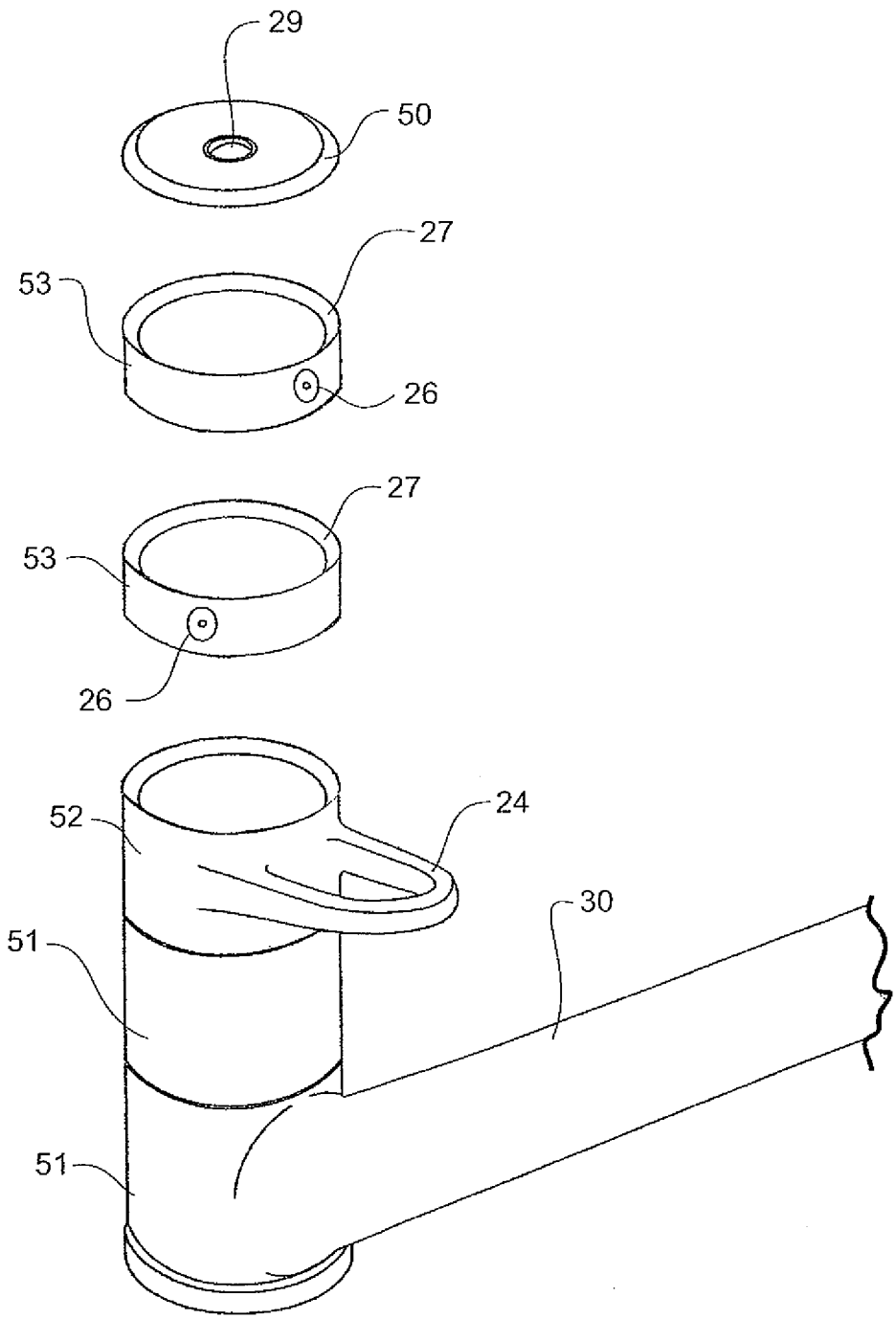
FIG. 6 is a schematic diagram showing assembly of the fire suppressing apparatus.

FIG. 6 provides an exploded view of the components of the fire suppression apparatus 19 in FIG. 5 that layer to construct the fire suppression apparatus 19 of the preferred embodiment. The fire suppression apparatus 19 has one or more base components 51 that are designed to mount to a surface. For example, the surface may be a kitchen bench. The base components 51 may also support the spout 30. Other components include a handle layer 52 that connects to the handle 24, one or more spray nozzle housing layers 53, and a cap 50.

Each of the spray nozzle housing layers 53 contains an internal fluid channel 27. Fluid channel 27 is designed to connect to fluid supply channel 45. Layering multiple spray nozzle housing layers fluidly connects the internal fluid channels between layers.

Cap 50 is designed to house or support the fire sensing device 28. Cap 50 is also designed to terminate fluid channel 27 when located above the uppermost spray nozzle housing layer 53.

Preferably each of the modular layers 50, 51, 52, 53 is interlocking and not separable or able to rotate when fastened together. Alternatively, it may be preferable to restrict only the spray nozzle housing layers from rotating, or changing their aimed direction when fastened together. In addition, the spray nozzle housing layers 53 may be freely rotated during installation to direct spray nozzles 26 in a desired direction, such as shown in FIG. 1.

Alternatively each of the spray nozzles may be plumbed directly to fluid supply channel 45, where the channel 45 is split as many ways as there are spray nozzles. The channel could be split by tee connections or similar.

Alternatively, each spray nozzle may be fluidly connected to the pressurised mains water supply source 22 via an independent valve. When the control unit senses a fire it selectively opens one or more of the valves.

Alternatively, each of the spray nozzles may be connected as a group that consists of one or more spray nozzles. Each group is connected to the pressurised mains water supply source 22 via an independent valve. When the control unit senses a fire it selectively opens one or more of the valves to fluidly connect one or more groups of spray nozzles.

Preferably the spray nozzle housing layers 53 are layered above the handle layer 52 and the one or more base layers 51. The protruding handle 24 and protruding spout 30 may intercept the spray pattern from the spray nozzles 26.

However, the spray nozzle housing layers may be placed below other layers if adequately spaced apart, or at least designed such the spray pattern is not intercepted. An interception of the spray pattern may cause detrimental performance to the fire suppressing intention of the apparatus.

Figure 7:
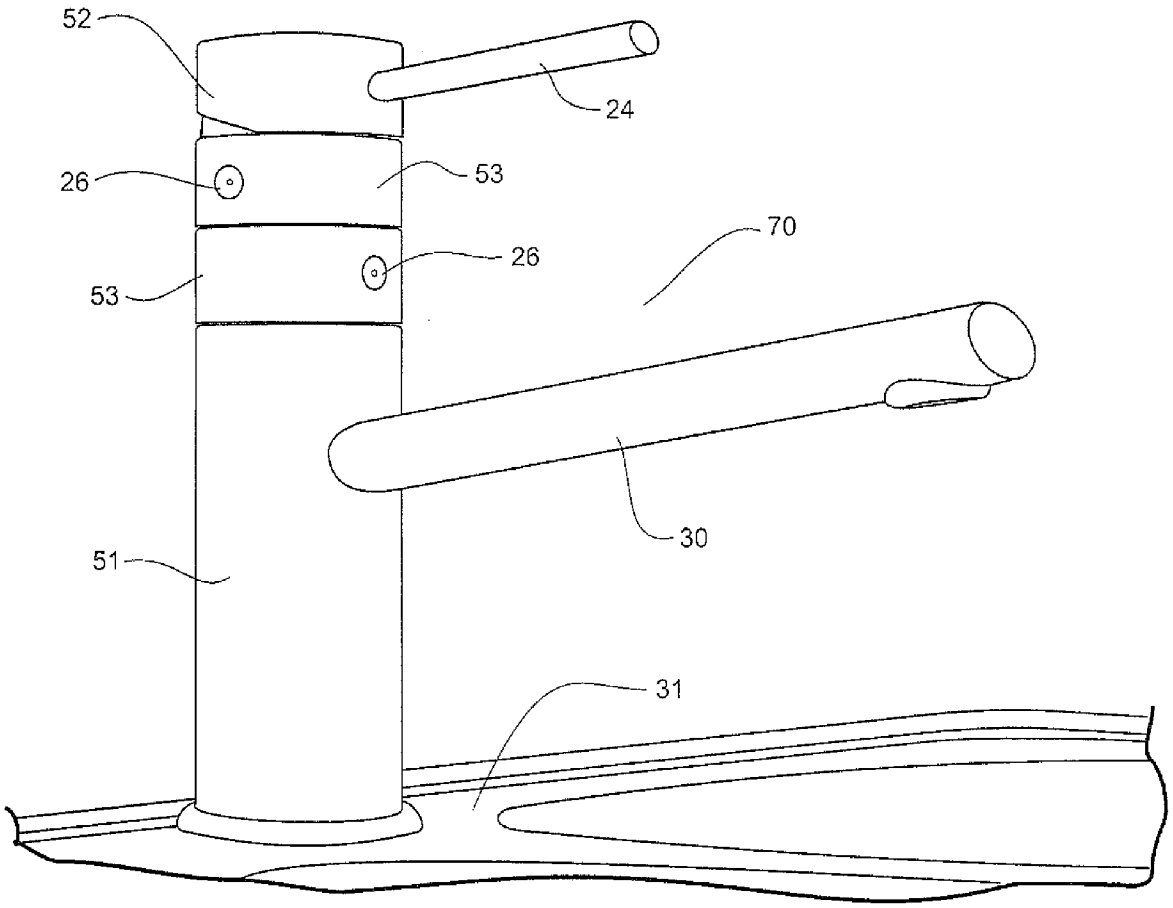
FIG. 7 is a perspective view of a further alternative exterior of the fire suppressing apparatus.
Figure 8:
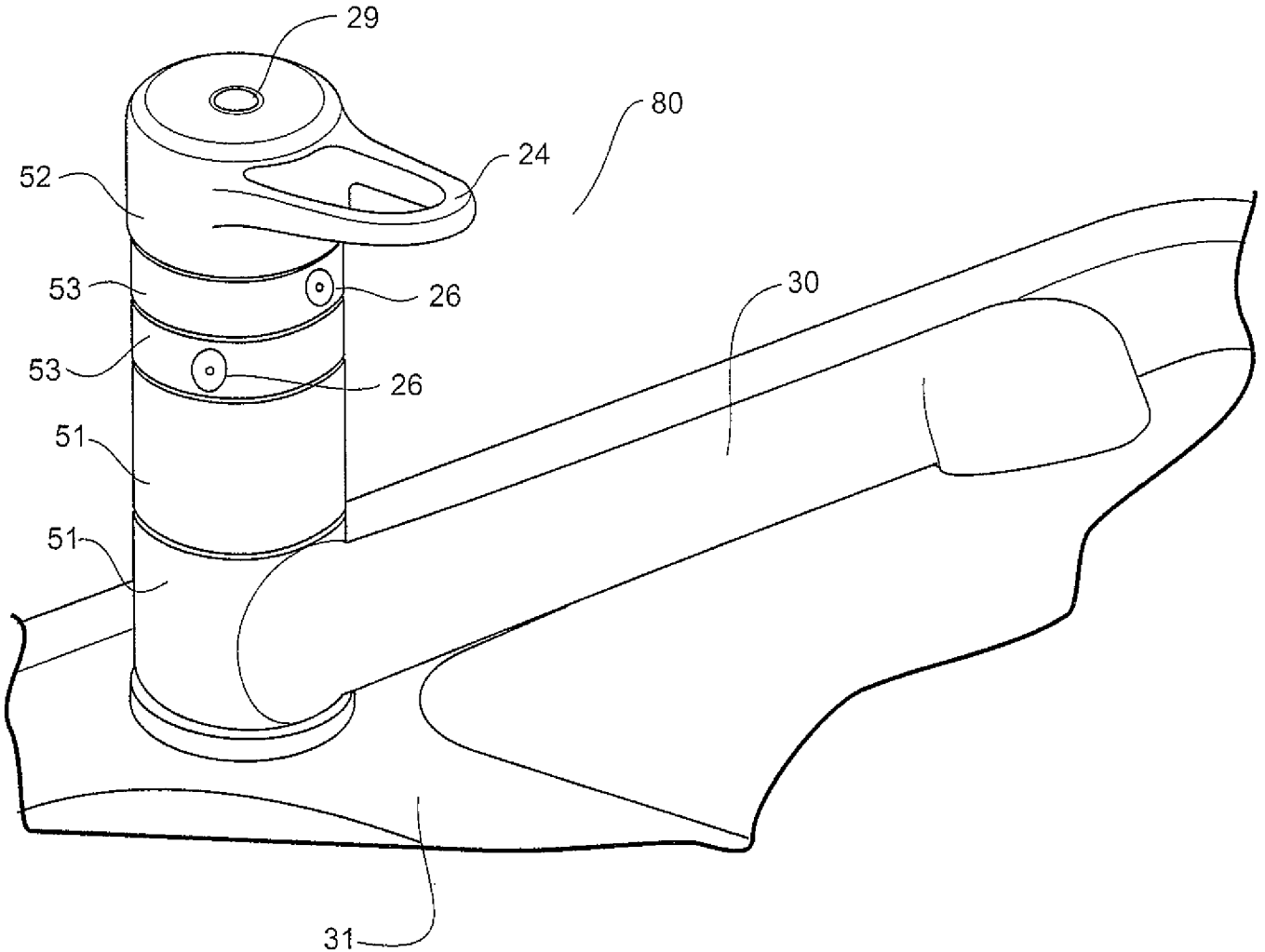
FIG. 8 is a perspective view of a further alternative exterior of the fire suppressing apparatus.

FIGS. 7 and 8 illustrate alternative exteriors 70, 80 and alternative layering of the interconnecting fire suppression apparatus components. Here, the spray nozzle housing layers 53 are located beneath the handle layer 52. It may be advantageous to locate the spray nozzles above the handle in certain situations where the handle 24 is large enough to intercept the spray pattern from the spray nozzle.

In another alternative, the fire suppression apparatus comprises a spout, without user operable valves and handles. In this case, the handles and valves (such as hot and cold water tap handles) are mounted proximate to the spout but separate.

Figure 9:
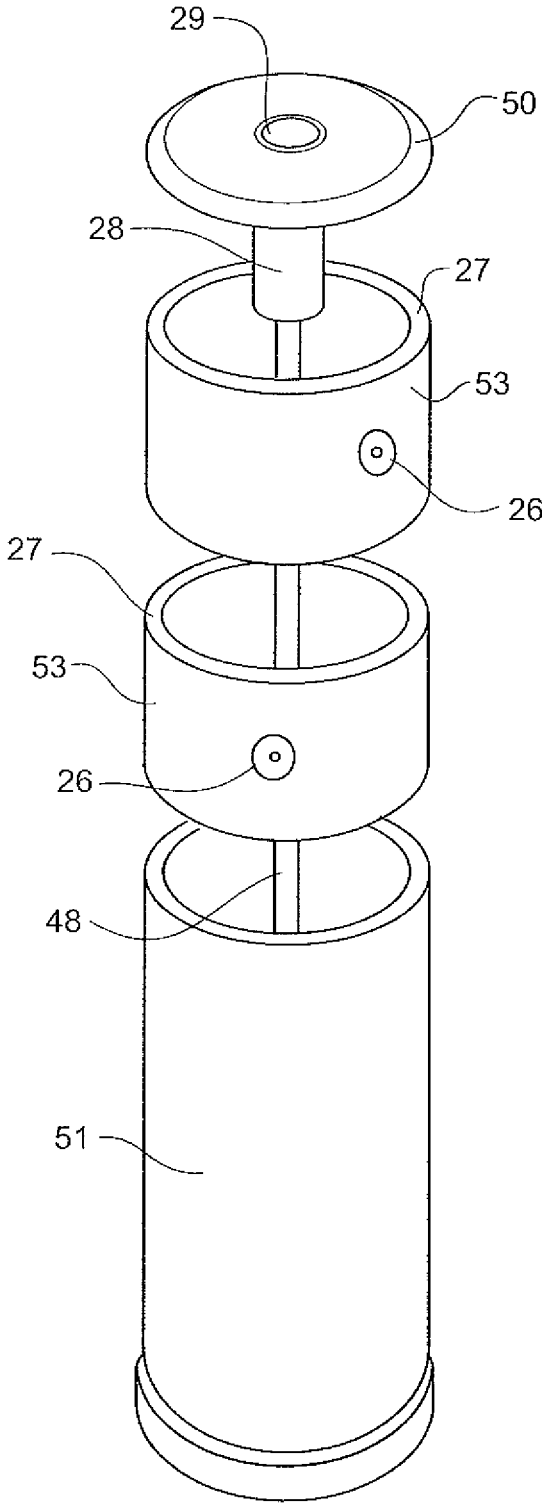
FIG. 9 is a perspective view of a second embodiment of a fire suppressing apparatus FIG. 10 perspective view of the fire suppressing apparatus according to the second embodiment showing internal features.
Figure 10:
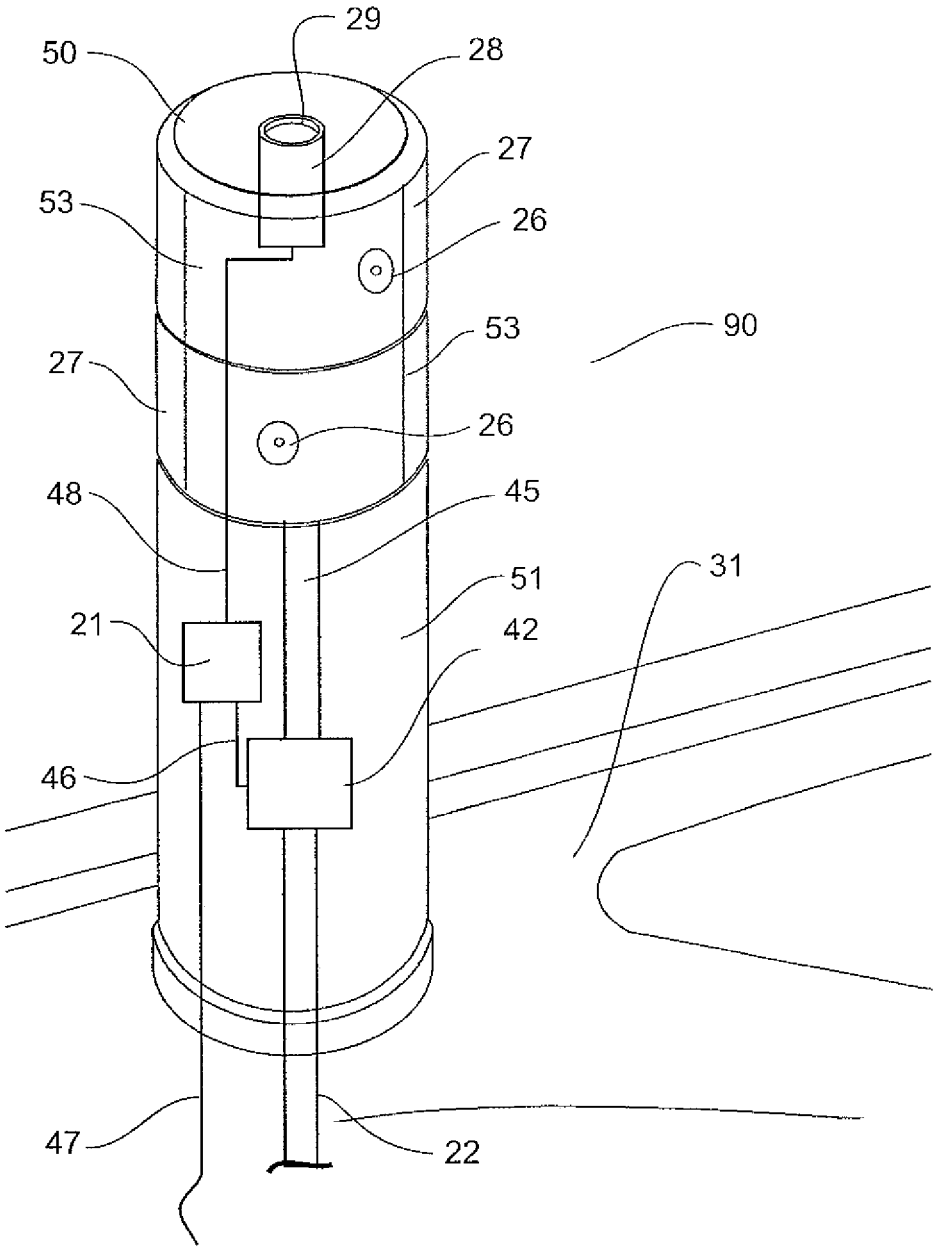

FIGS. 9 and 10 illustrate a view of a second embodiment of the fire suppression apparatus. FIG. 9 shows the apparatus in expanded form. The second embodiment is formed by layering a base unit 51, one or more spray nozzle housing layers 53 and a terminating cap 50. The fire suppression apparatus of the second embodiment is intended to be installed on a surface proximate an existing faucet, or at least proximate an existing water supply. In this way the apparatus can be installed in an existing area containing potential fire hazards.

An advantage the apparatus of the second embodiment provides is the versatility to be positioned with clear line of sight to a potential fire hazard. The apparatus may also be installed by, for example, a home owner that does not want to change their existing faucet.

The spray nozzles 26 can be rotated such that they can be aimed in the direction of a potential fire hazard when the apparatus is installed. The apparatus may be installed on a bench top or kitchen sink top nearby and existing faucet or somewhere convenient in the kitchen.

The spray pattern of each of the spray nozzles can be customised to best suit the potential fire hazards in the area.

Each of the spray nozzle housing layers 53 contains an internal fluid channel 27. Fluid channel 27 is designed to connect to fluid supply channel 45. Layering multiple spray nozzle housing layers fluidly connects the internal fluid channels between layers.

Figure 11:
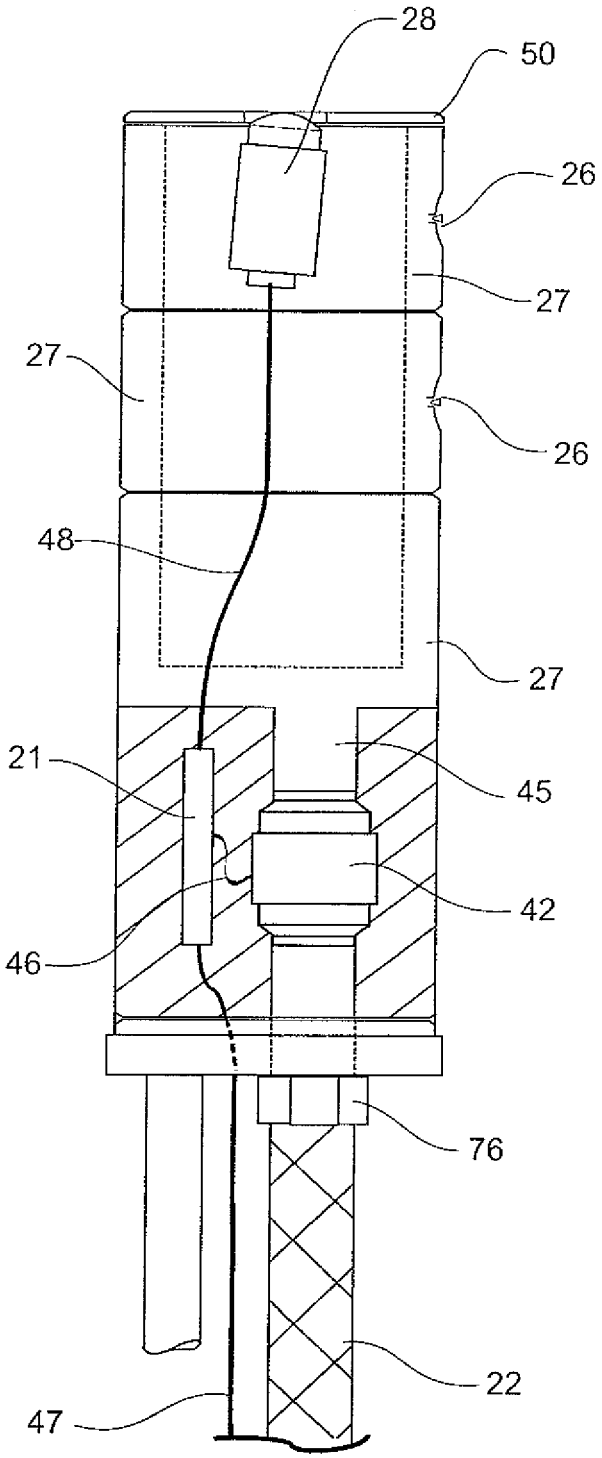
FIG. 11 is a cross sectional view of the fire suppression apparatus according to the second embodiment.

FIG. 11 shows an internal view of the second embodiment where the controller 21 and valve 42 are housed internal to the fire suppression apparatus. The apparatus has a fluid channel 22 connected to the valve 42. Valve 42 is electrically opened and closed by a controller 21 via wire 46. A fire sensor 28 is electrically connected to the controller 46 via wire 48. Valve 42 is opened by controller 21 when a fire is sensed. Fluid channel 22 is fluidly connected to one or more spray nozzles 26 via internal fluid channel 27 when the valve 42 is opened.

Fluid channel 22 may be a length of pipe having an adaptation for connecting to an existing mains water supply. The adaptation may comprise a tee connection that separates the water supply into at least two paths as shown in FIG. 4. The fluid channel may also be connected to the base of the unit via a connection 76. The connection 76 may be a standard threaded connection as is commonly used in the plumbing industry, or it may be attached by other similar methods, such as welding or an interference fit.

Figure 12:
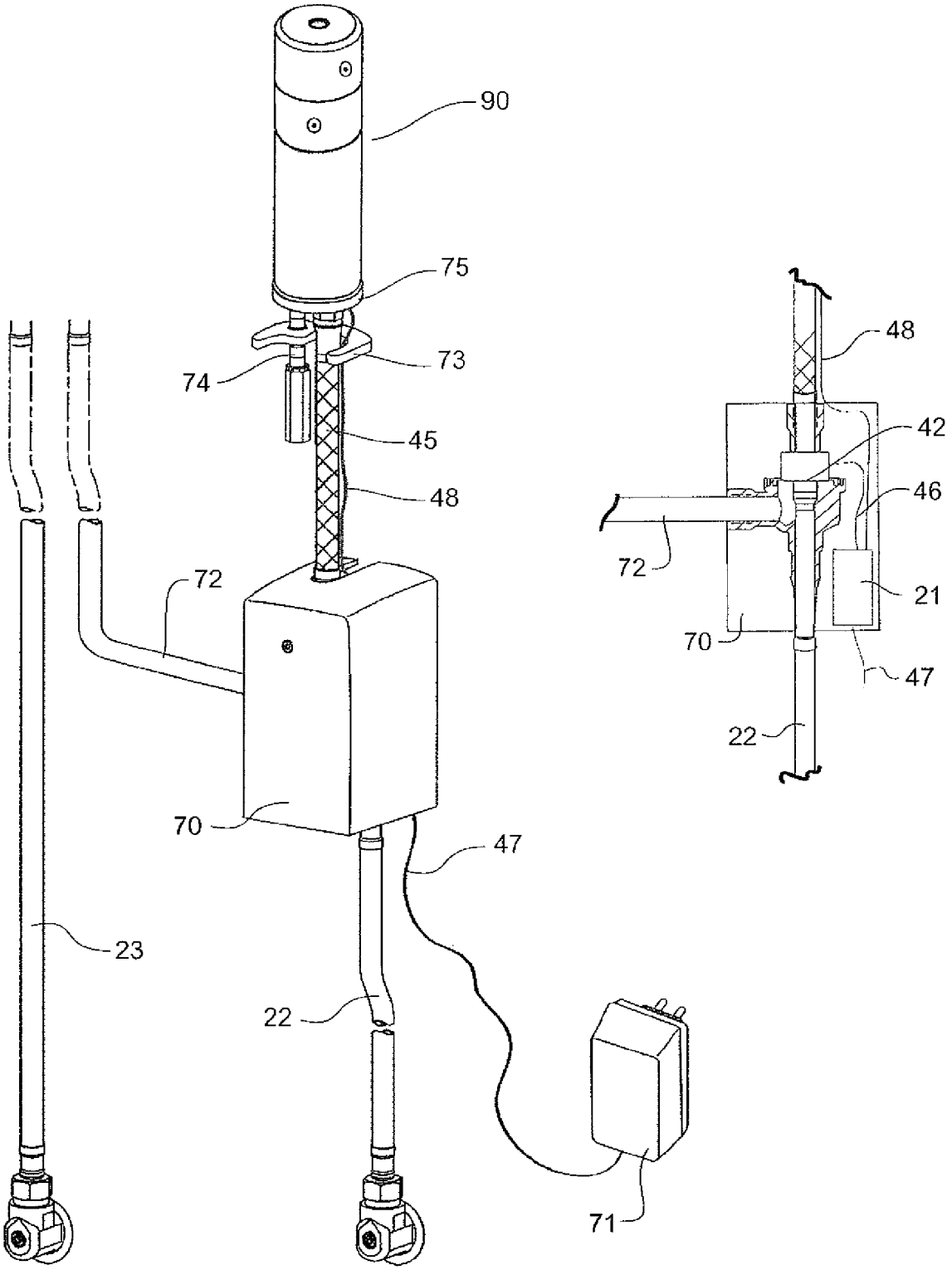
FIG. 12 is an illustration of the fire suppressing apparatus of the second embodiment.

FIG. 12 is a diagram of the fire suppression apparatus according to the second embodiment having the controller 21 and valve 42 housed externally. The controller 21 and valve 42 are contained within an outer housing 70. The housing 70 can be attached to a convenient wall or inside surface of a cupboard or bench. The housing 70 protects the valve and controller structure from external interference. In addition, the housing 70 may physically support the components contained internally.

The controller 21 is supplied with power from an external wall adapter unit or mains connection 71 via wire 47. The controller 21 outputs electrical control signals to nearby valve 42 via wire 46, in response to electrical signals from the remote fire sensor via wire 48.

A cold water supply channel 22 is supplied to the housing 70. A hot water supply 23 is not connected to the apparatus. The water supply 22 is fluidly connected to the valve 42 inside the housing 70. Water channel 72 exits the housing 70 and may connect to existing nearby faucets or other water consuming devices. The water supply channel 22 is fluidly connected to water channel 72 during normal operation. When a fire is detected, the water channel 22 is fluidly connected to the spray nozzles and fluidly disconnected from channel 72.

A clamping surface 73 is attached to the lower end of the fire suppression apparatus via a threaded member 74. The threaded member 74 can be spun to raise and lower the height of the clamping surface 73 relative to the base of the apparatus 75. The apparatus can therefore be secured to a bench top via the clamping surface. For example, the apparatus 90 can be located above an aperture in the bench that allows the water channel 45 and electrical connection 45 to pass through. The threaded member 74 is rotated until the clamping surface 73 has been pressed into the lower surface of the bench top thus securing the apparatus.

Figure 13:
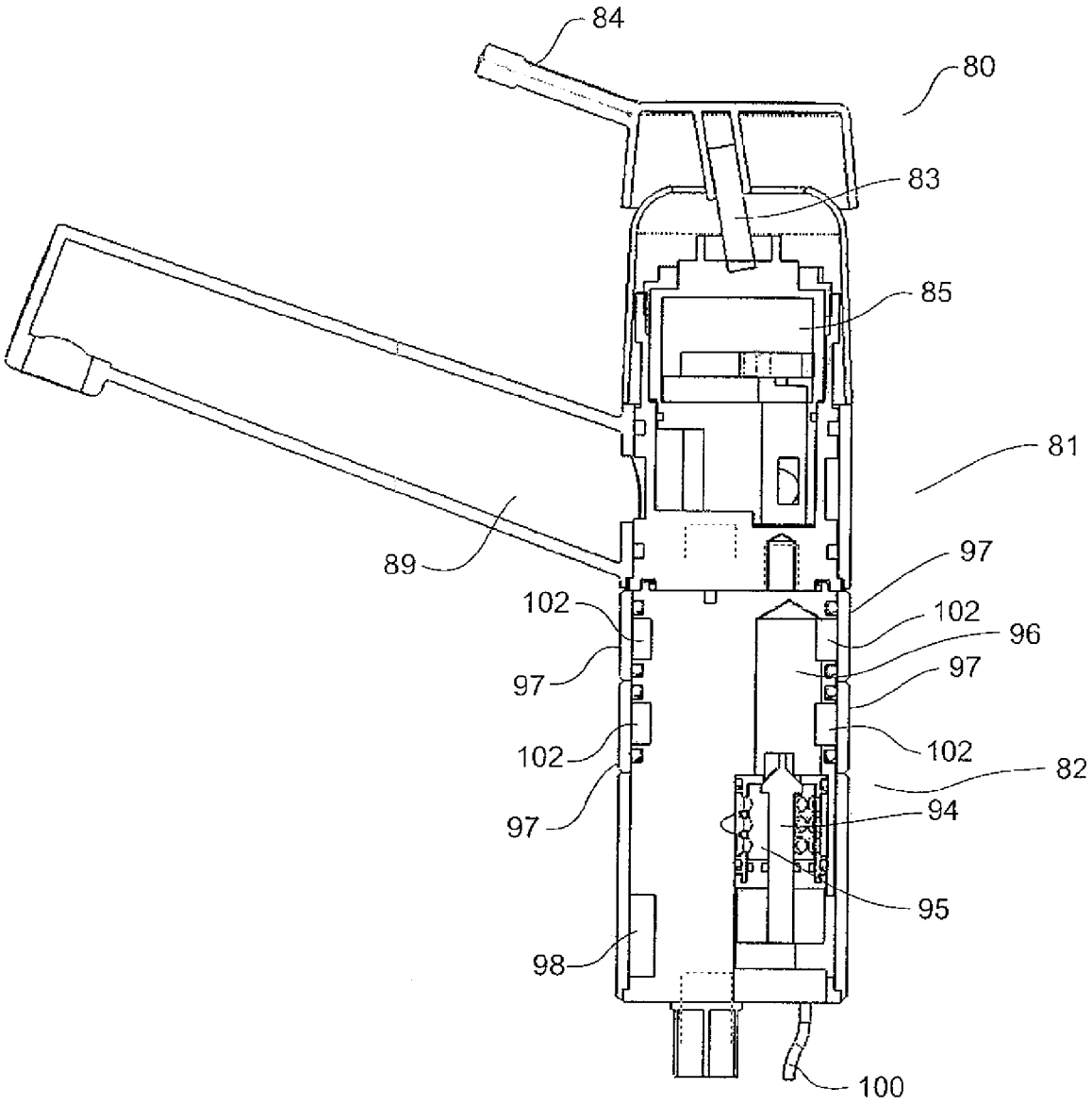
FIG. 13 is cross sectional view of the fire suppressing apparatus according to a third embodiment.
Figure 14:
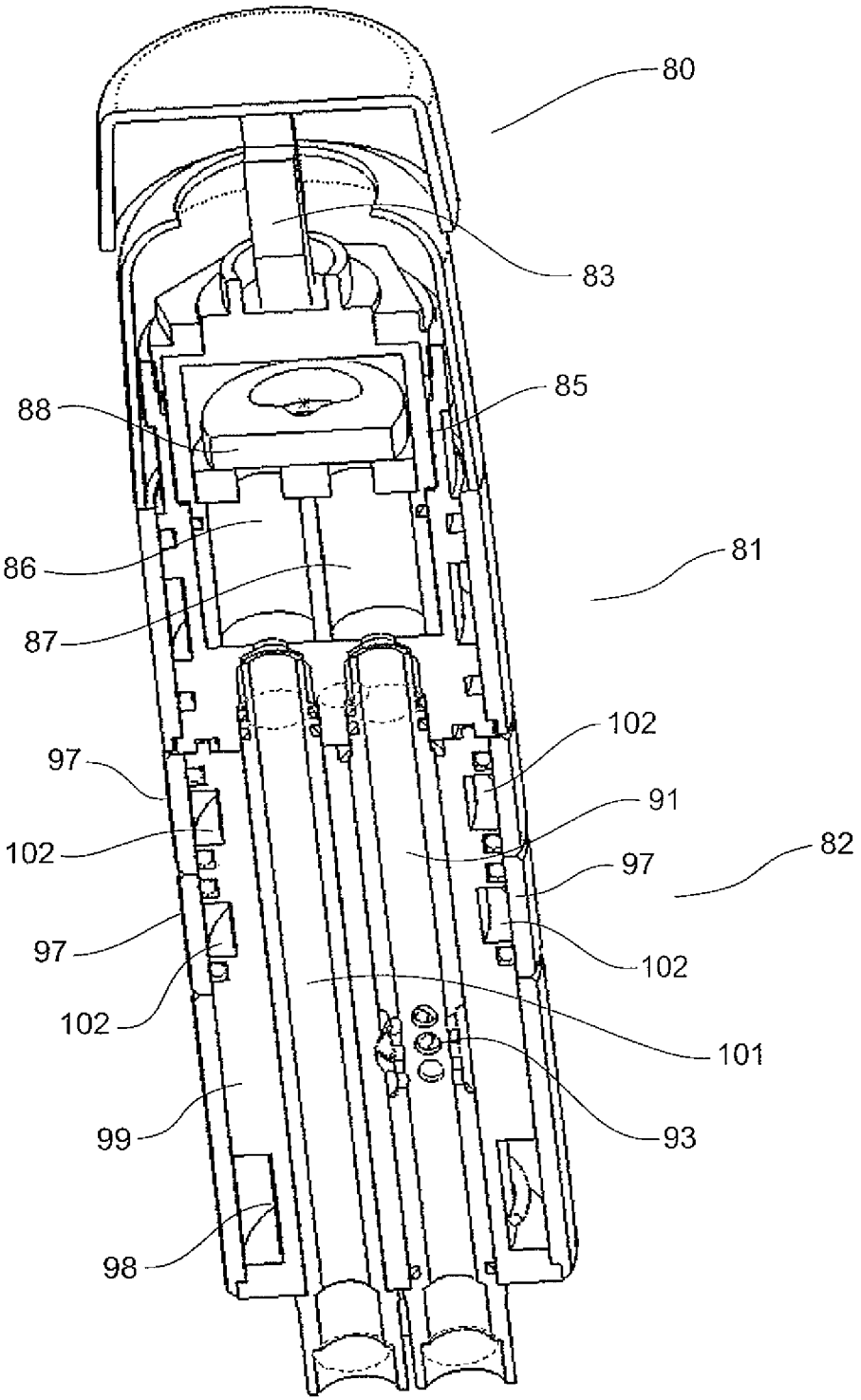
FIG. 14 is a cross sectional view of the fire suppressing apparatus of FIG. 13 showing a different section angle.
Figure 15:
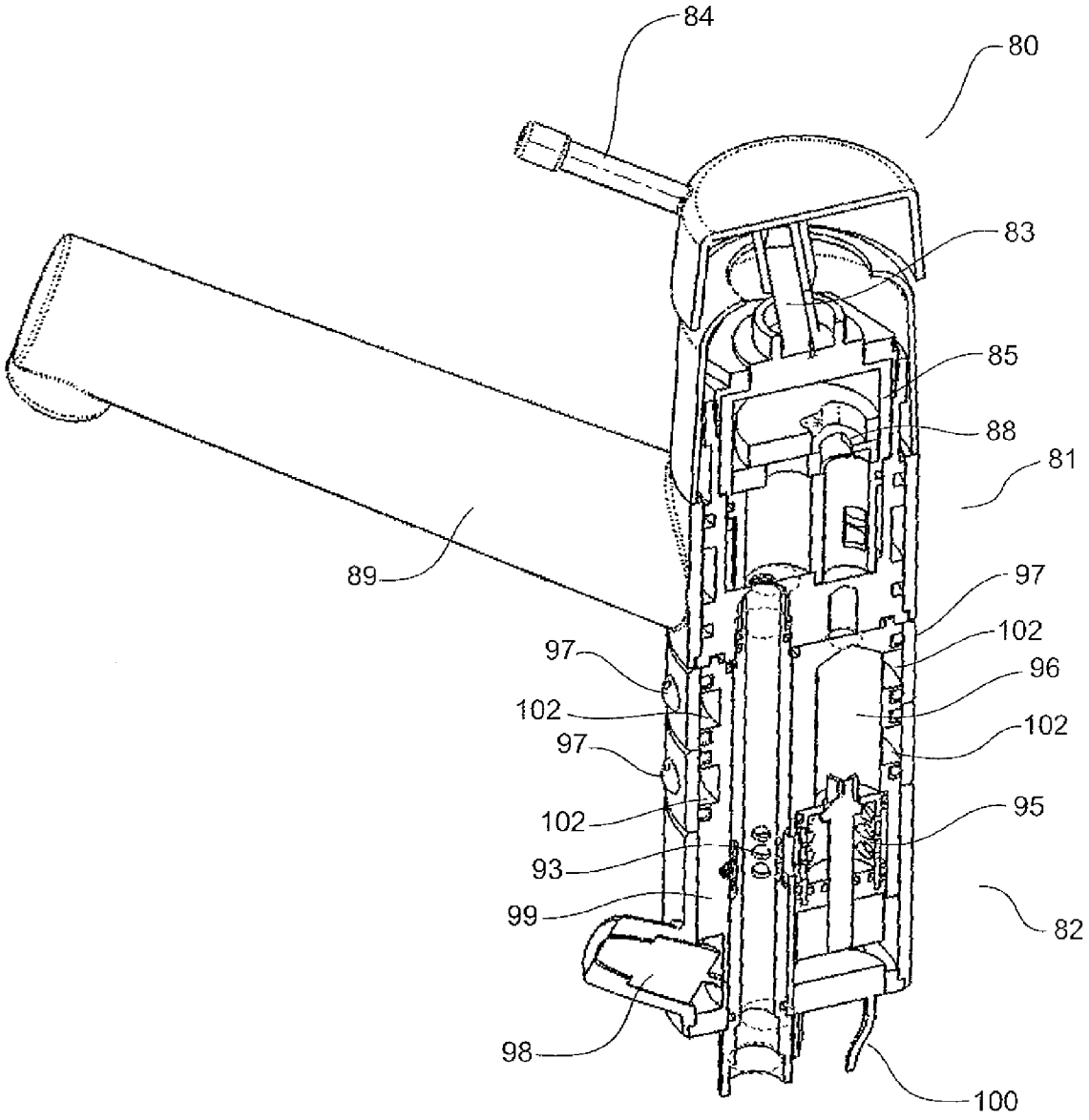
FIG. 15 is a cross sectional view of the fire suppressing apparatus of FIGS. 13 and 14 showing a different section angle.

FIGS. 13, 14 and 15 show a cross sectional view of a third embodiment of the fire suppression apparatus of the present invention from various angles.

Referring generally to these three figures, the third embodiment consists of three main sections. These are the handle section 80 located at the top of the unit, the faucet section 81 located in the centre of the unit and the fire suppression section 82 located at the base of the unit.

The handle section 80 has a linkage 83 that connects the handle 84 to a mixer unit 85. The mixer unit 85 is a mixer cartridge of the type commonly used in the faucet industry. The mixer cartridge is typically a valve that receives a hot and cold water supply via input channels 86, 87. A ceramic plate 88 swivels to control the mix ratio of the hot and cold water supplies before channelling the mix to a spout 89. Those skilled in the art will know how this mixer cartridge operates.

The hot and cold water supply is fed via water channels 101, 91 respectively. The cold water supply channel 91 has an aperture, or apertures 93 for water to flow through into a valve 94. Preferably the valve 94 is an electromagnetic two way valve. Water remains in a lower chamber 95 when the valve 94 is closed or in a de-energised state. When the valve 94 is open, or in an energised state, water is allowed to flow through the apertures 93, the lower chamber 95 and into an upper chamber 96.

Preferably upper chamber 96 fluidly extends around the periphery of the lower section of the unit 82 to form an annular fluid channel 102. The upper chamber 96 is in fluid communication with a set of spray nozzles 97 via the annular fluid channel 102. When valve 94 is open, water from the water supply channel 91 is fluidly connected to spray nozzles 97. The fluid connection of the pressurised water supply to the spray nozzles 97 provides a stream of water that may be used to suppress a fire.

Located at the base of the fire suppression apparatus is a fire sensor 98. The fire sensor 98 can be aimed at the ceiling of a room above a potential fire hazard. The fire sensor is electrically connected to an embedded controller unit 99. The controller unit receives power via an electrical connection 100 and an input from the fire sensor 98. The controller 99 outputs a control signal to valve 94 when the fire sensor 98 detects the occurrence of a fire. The valve 94 subsequently opens to allow pressurised water to flow from water channel 91 through the apertures 93, through the lower chamber 95 into upper chamber 96 and therefore to the spray nozzles 97 via annular channel 102.

When the fire sensor 98 no longer detects the occurrence of a fire, or a predefined amount of time has elapsed, the controller 99 sends a control signal to close valve 94. The control signal to close valve 94 includes de-energising the electromagnetic coils in the valve 94 to allow it to close.

Figure 16:
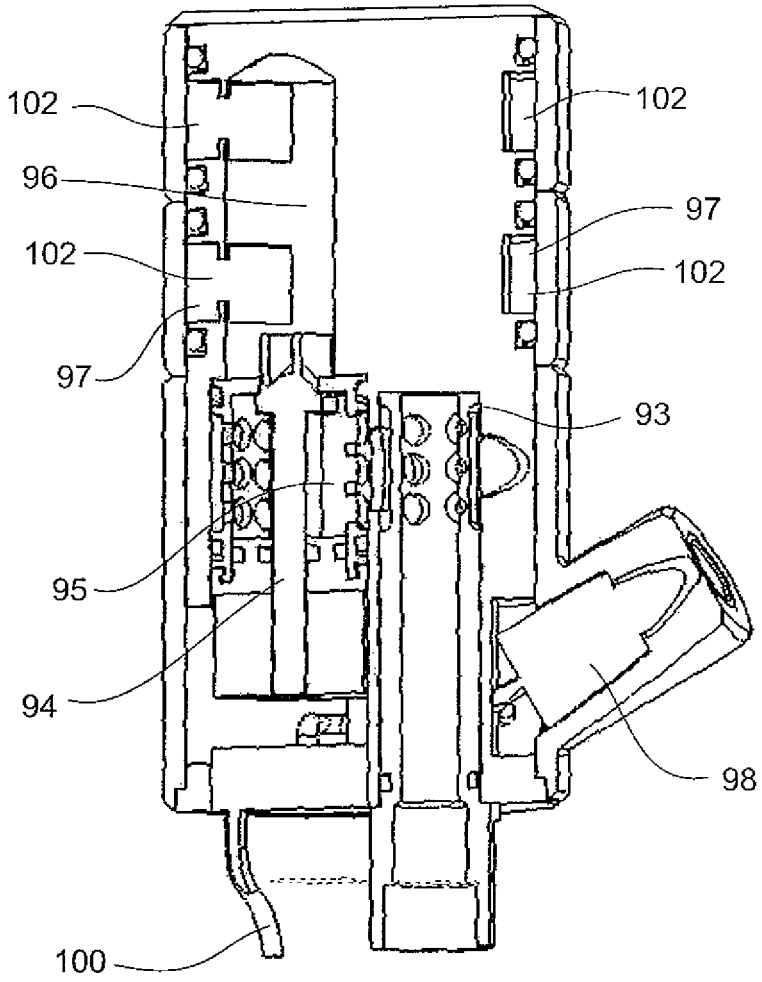
FIG. 16 is a cross sectional view of a further embodiment of the present invention.

Another embodiment of the apparatus of the present invention is shown in FIG. 16. This functions in the same manner as the embodiment as shown and described in relation to FIGS. 13 to 15. However, this embodiment does not function as a faucet.

Figure 17:
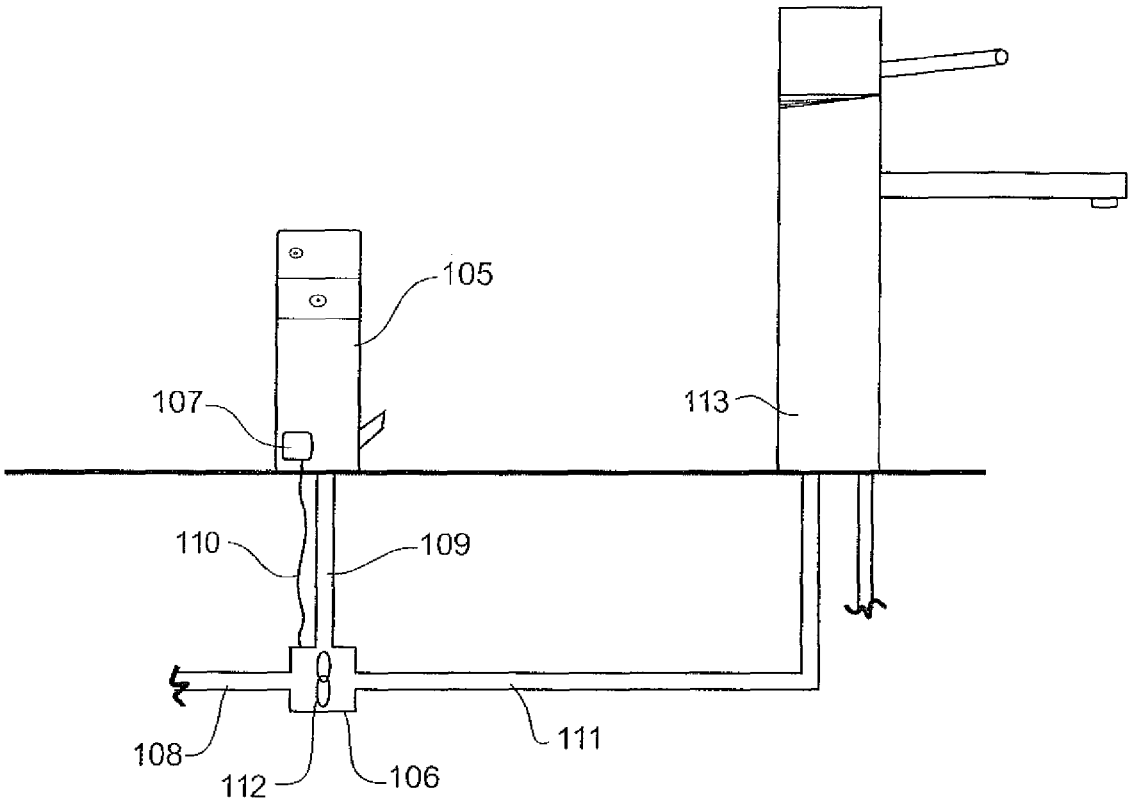
FIG. 17 is an illustration of the fire suppression apparatus of the present invention incorporating a hydroelectric generator.

FIG. 17 shows one embodiment of fire suppression apparatus 105 connected to a hydroelectric generator 106. The generator 106 is located in a water supply channel that supplies the fire suppressing apparatus 105 and a nearby faucet 113. The generator has a propeller or turbine 112 that is spun by water flow to generate electricity.

The generator 106 could be located in the water channel 111 that supplies the nearby faucet or the main water supply channel 108. Alternatively the generator 106 could be located at the intersection of the main water supply channel 108, the supply channel 108 to the faucet 113 and the supply channel 109 to the fire suppression device 105.

Electrical power generated by the spinning propeller 112 is connected by wire 110 to the fire suppression device 105. Preferably the fire suppression device incorporates a rechargeable battery 107 connected to the supply of power from the generator. The rechargeable battery 107 is used to supply power to the other electrical components housed in the fire suppression device.

A solar panel may be incorporated into the fire suppression device instead of the hydroelectric generator. Alternatively, the solar panel could work in parallel to the hydroelectric generator. Preferably the solar panel would be positioned in a sunlit location. The solar panel is connected to the rechargeable battery. The battery supplies electrical charge to the electrical components in the fire suppression device. Additionally, the solar panel recharges the battery. The solar panel may also be used to directly power one or more of the electrical components in the fire suppression device when output power is sufficient to do so.

FIG. 17 shows the fire suppression device as a stand alone unit. The generator 106, battery and/or solar panel could be incorporated into a fire suppression device that is part of a faucet, such as described earlier. Further, a standard battery could be used in place of the rechargeable battery.

The first, second and third embodiment can be supplied as a complete unit, or a kit of parts for assembly into a complete unit.

What is claimed is:

1. A surface mounted fire suppression apparatus to install on a kitchen or laundry bench or sink top and connect to a water supply proximate the bench or sink top, the apparatus comprising:

a. a base adapted to mount to a surface;

b. one or more misting spray nozzles connected to the base, c. at least one valve operable into an open position to fluidly couple the one or more misting spray nozzles to a proximate water supply, d. a controller responsive to a signal from a fire sensor to actuate the at least one valve into the open position, and e. a clamping assembly for clamping the base to the bench or sink top.

2. A fire suppression apparatus according to claim 1 wherein the one or more misting spray nozzles are directable.

3. A fire suppression apparatus according to claim 1 wherein the one or more misting spray nozzles are rotatable with respect to the base.

4. A fire suppression apparatus according to claim 3 wherein the one or more misting spray nozzles are rotatable about a generally vertical axis.

5. A fire suppression apparatus according to claim 4 wherein each misting spray nozzle is mounted in a rotatable housing that is rotatable with respect to the base.

6. A fire suppression apparatus according to claim 1 including a plurality of misting spray nozzles.

7. A fire suppression apparatus according to claim 2 including a plurality of misting spray nozzles.

8. A fire suppression system including a fire suppression apparatus according to claim 1 and a fire sensor.

9. A fire suppression system according to claim 8 wherein the fire sensor is a non-contact sensor.

10. A fire suppression system as claimed in claim 8 wherein the fire sensor is a temperature sensor.

11. A fire suppression system as claimed in claim 10 wherein the temperature sensor is positioned to detect a ceiling temperature when the fire suppression apparatus is installed on a surface proximate a water supply.

12. A fire suppression system as claimed in claim 10 wherein the controller is adapted to monitor the temperature sensor and actuate the at least one valve into the open position when the temperature sensor senses a temperature above a first threshold.

13. A fire suppression system as claimed in claim 12, wherein the threshold is in the range of 40°-70° Celsius.

14. A fire suppression apparatus according to claim 1 wherein the clamping assembly includes a clamping surface that may be adjustably positioned relative to the base.

15. A fire suppression apparatus according to claim 14 wherein the adjustable positioning is performed by a rotatable threaded member.

16. A fire suppression apparatus as claimed in claim 1 further comprising a power source for the apparatus, the power source being one or more of: a battery, mains supply, a solar panel and a generator.

* * * * *